US005458287A

United States Patent [19]

Jones et al.

[11] Patent Number: 5,458,287

[45] Date of Patent: Oct. 17, 1995

[54] PREFABRICATED BAY WINDOW CONSERVATORY ENCLOSURE FOR RECYCLABLE WASTE RECEPTACLES

[76] Inventors: Dietrick C. Jones, 3106 S. 337th St., Auburn, Wash. 98001; Glenda M. Jones, 1506 Main St., Milton, Wash. 98354

[21] Appl. No.: 967,301

[22] Filed: Oct. 27, 1992

[51] Int. Cl.[6] ..... B65D 91/00; E06B 1/38

[52] U.S. Cl. ..... 232/43.1; 232/43.5; 52/201; 220/909

[58] Field of Search ..... 232/43.1, 43.2, 232/43.5; 220/909, 477; 52/201, 34, 169.6; 248/901

[56] References Cited

U.S. PATENT DOCUMENTS

| | | | |
|---|---|---|---|
| 2,177,328 | 10/1939 | Pender . | |
| 2,474,101 | 6/1949 | Frothingham | 232/43.2 |
| 2,802,434 | 8/1957 | Dowse . | |
| 3,171,447 | 3/1965 | Fowler et al. . | |
| 3,204,740 | 9/1965 | Legault . | |
| 3,211,367 | 10/1965 | Jessop | 232/43.2 |
| 3,279,685 | 10/1966 | Price | 232/43.2 |
| 3,510,055 | 5/1970 | Safford | 232/43.2 |
| 3,554,345 | 1/1971 | Mullens | 193/33 |
| 3,664,576 | 5/1972 | Potvin | 232/43.2 |
| 3,754,501 | 8/1973 | Horn | 232/43.1 |
| 3,863,561 | 2/1975 | Karls | 232/43.1 |
| 4,013,215 | 3/1977 | Mercier | 232/43.1 |
| 4,637,545 | 1/1987 | Stewart | 232/43.2 |
| 4,987,988 | 1/1991 | Messing | 232/43.2 |
| 5,007,581 | 4/1991 | Douglas | 232/43.2 |
| 5,083,704 | 1/1992 | Rounthwaite . | |

FOREIGN PATENT DOCUMENTS

| | | | |
|---|---|---|---|
| 50132 | 4/1979 | Japan | 52/201 |
| 176587 | 7/1991 | Japan | 52/201 |
| 4031589 | 2/1992 | Japan | 52/201 |
| WO9008714 | 8/1990 | WIPO | B65F 1/00 |

*Primary Examiner*—Flemming Saether
*Attorney, Agent, or Firm*—Robert W. Beach

[57] ABSTRACT

A prefabricated conservatory enclosure for a waste recycling center to be attached to a building includes an upper bay window recess having a bottom counter and a lower housing for enclosing one or more receptacles for recyclable material, the counter having openings for deposit of waste into the receptacles from the upper recess, and the lower portion of the enclosure having an integrating wall fitted with plumbing for a kitchen sink and adapted to be integrated with the structure of a building to which the enclosure is annexed.

6 Claims, 6 Drawing Sheets

PREFABRICATED BAY WINDOW CONSERVATORY ENCLOSURE FOR RECYCLABLE WASTE RECEPTACLES

BACKGROUND OF THE INVENTION

1. Field of the Invention

This invention relates to an auxiliary structure including a bay window conservatory and a recycling center housing a receptacle or receptacles for receiving recyclable waste which is attached or attachable to a building.

2. Prior Art

The following U.S. patents disclose various arrangements for locating a receptacle or receptacles for holding waste exteriorly of a building with an arrangement for depositing from the interior of the building into the receptacle or receptacles disposable material:

| Inventor | U.S. Pat. No. | Issue Date |
|---|---|---|
| Pender | 2,177,328 | October 24, 1939 |
| Dowse | 2,802,434 | August 13, 1957 |
| Fowler et al. | 3,171,447 | March 2, 1965 |
| Legault | 3,204,740 | September 7, 1965 |
| Mullens | 3,554,345 | January 12, 1971 |
| Mercier | 4,013,215 | March 22, 1977 |
| Messina et al. | 4,987,988 | January 29, 1991 |
| Douglas | 5,007,581 | April 16, 1991 |
| Rounthwaite | 5,083,704 | January 28, 1992 |

Of these patents, the Mercier U.S. Pat. No. 4,013,215 shows in FIG. 1 an enclosure for a conventional garbage can in the form of a shed attached to the building.

In addition, Patent Cooperation Treaty Publication WO 90/08714, published Aug. 9, 1990, discloses an arrangement for several receptacles into a selected one of which recyclable waste can be deposited.

Jessop U.S. Pat. No. 3,211,367, issued Oct. 12, 1 965, discloses a holder for a bag into which waste can be deposited, which holder is constructed to fit between the studs and partially within the walls of a house.

SUMMARY OF THE INVENTION

A principal object of the invention is to provide an auxiliary structure enclosure for a receptacle or receptacles for holding recyclable waste that can be attached to a building and which is of attractive appearance.

The enclosure is designed to conceal a receptacle or receptacles into which waste can be deposited directly instead of having to pass through a chute into such a receptacle.

A further object is to provide an auxiliary structure enclosure that can be prefabricated and which is adapted to be integrated structurally with a building to which it is attached.

An incidental object is to utilize a structural integrating wall of the enclosure as a utility wall for housing plumbing and electrical wiring.

The foregoing objects can be accomplished by an auxiliary structure to be attached to a building including a conservatory window recess upper portion open on the inside and a lower portion for enclosing a waste receptacle or receptacles and having an integrating wall jutting out from the inner side of the enclosure beyond the plane of the upper portion recess opening and which is adapted to be structurally integrated with the building structure and may contain plumbing and/or electrical wiring.

DETAILED DESCRIPTION

Figure 1:
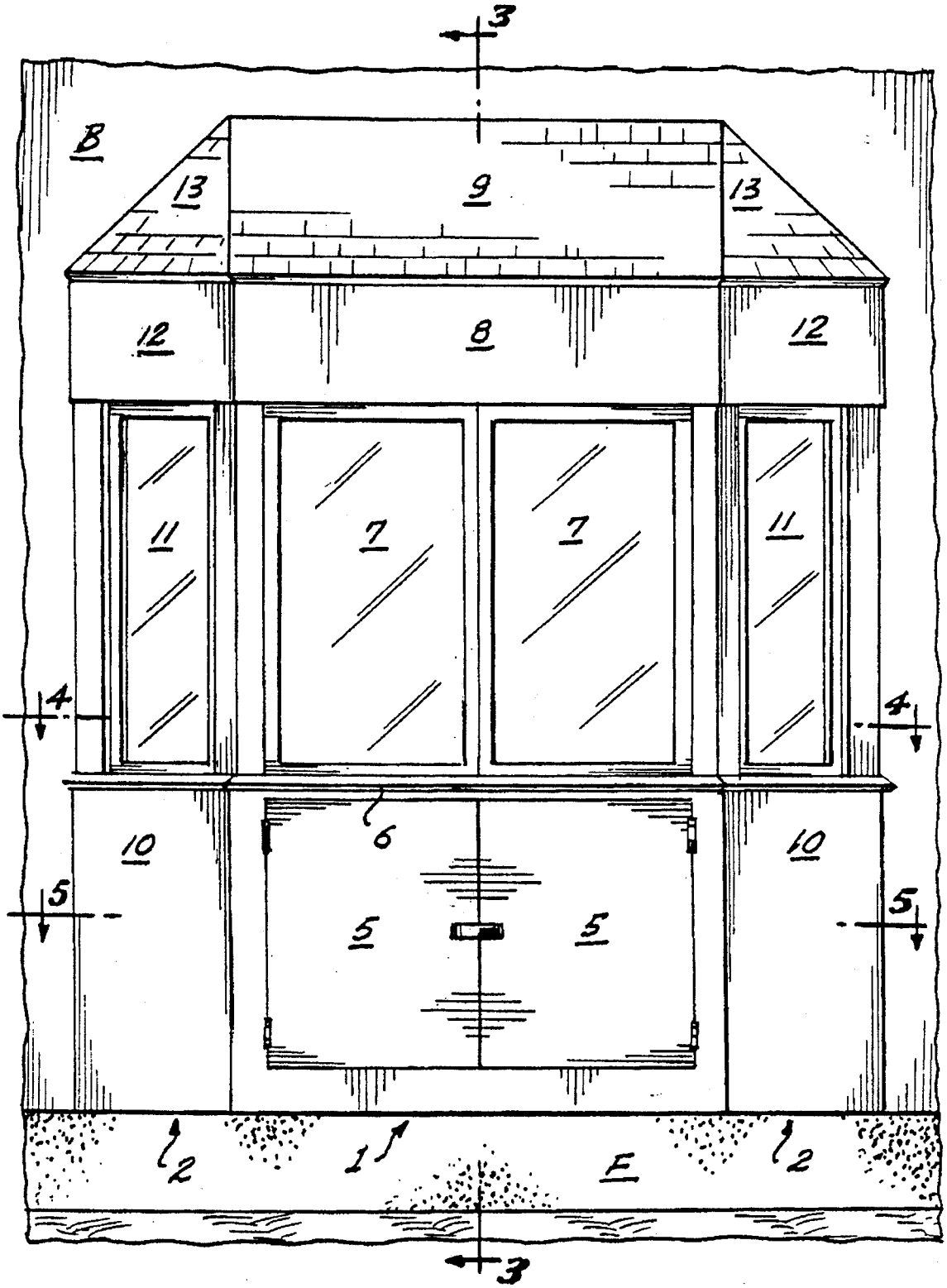
FIG. 1 is a front elevation of an auxiliary structure including a conservatory and a housing for receptacles to hold recyclable or disposable waste according to the present invention.
Figure 3:
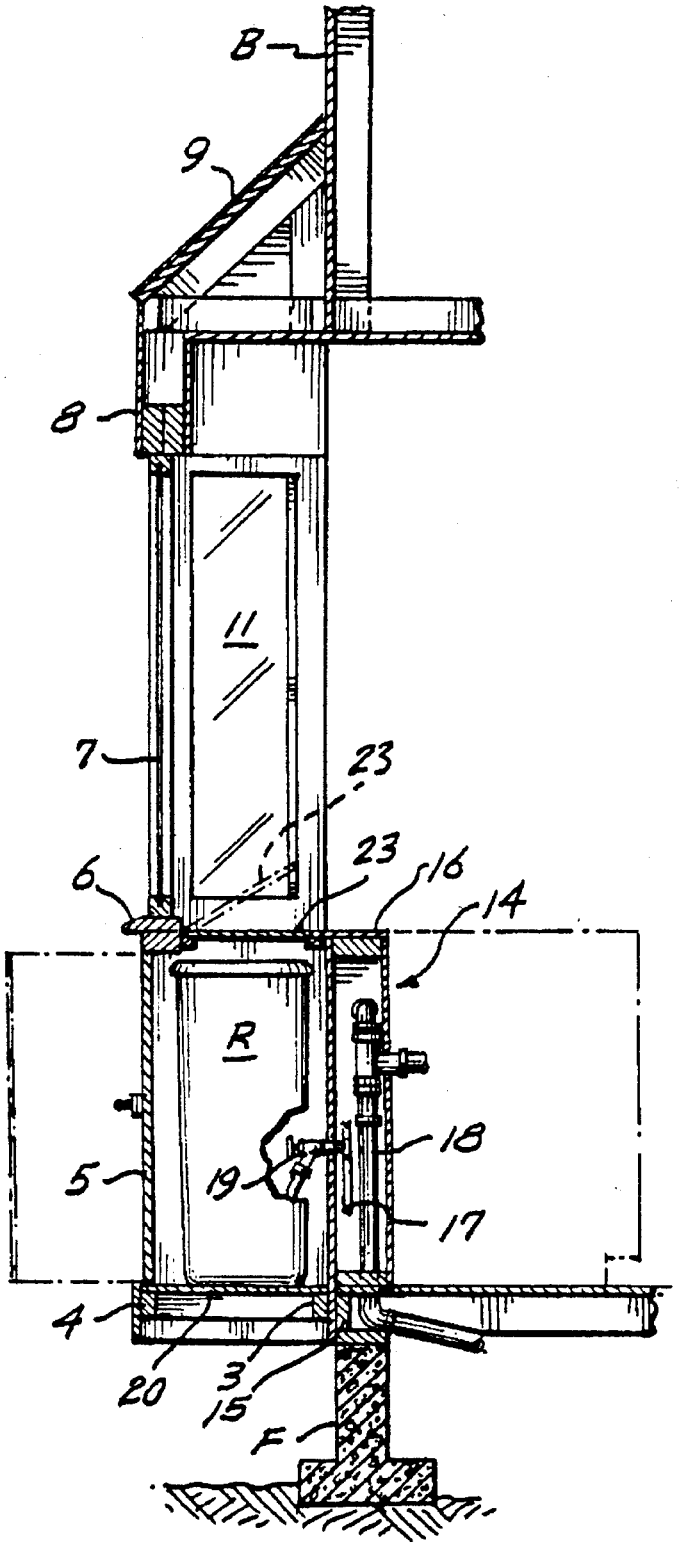
FIG. 3 is a vertical section through the auxiliary structure taken along line 3—3 of FIG. 1.
Figure 4:
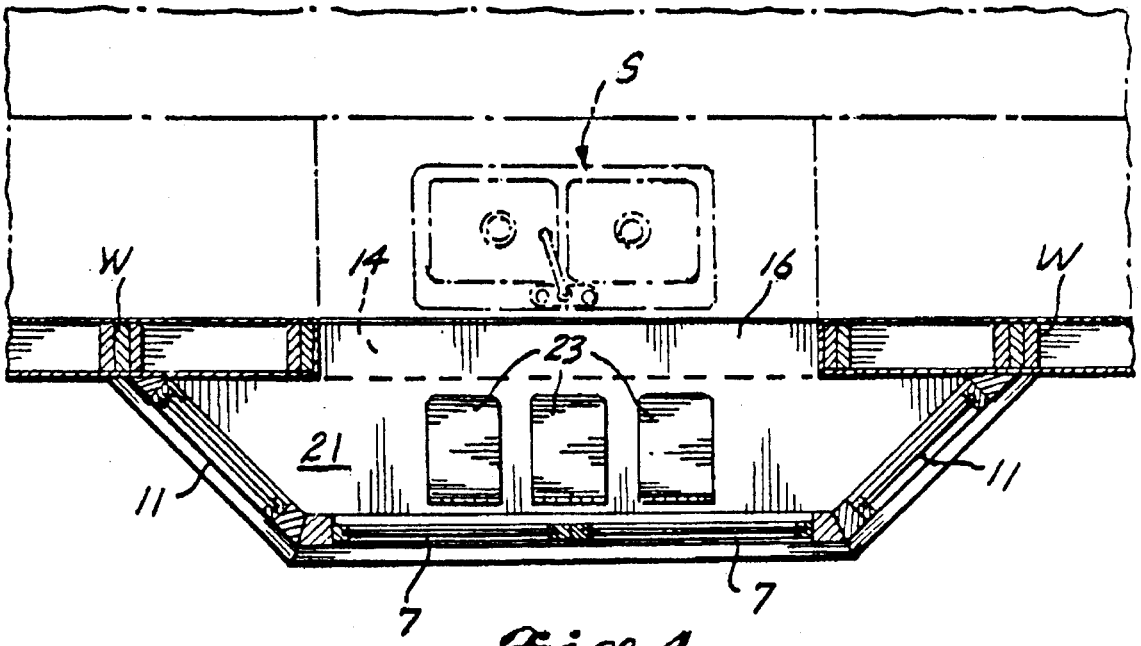
FIG. 4 is a horizontal section through the auxiliary structure of FIG. 1 taken along line 4—4 of that figure.

The auxiliary structure conservatory window recycling center enclosure of the present invention including an upper outer wall of generally U-shaped horizontal cross section as outer wall of generally U-shaped horizontal cross section as shown in FIG. 4 forming a bay window and an inwardly-opening recess is preferably made available as a prefabricated auxiliary structure. As shown in FIG. 1, the structure includes a front main panel 1 which, when the auxiliary structure is incorporated into a building B, would be spaced outward from the foundation F shown in FIGS. 2 and 3 and from the wall of the building above the foundation. The structure has an inner floor joist 3 and an outer floor joist 4 for carrying the structure.

Figure 5:
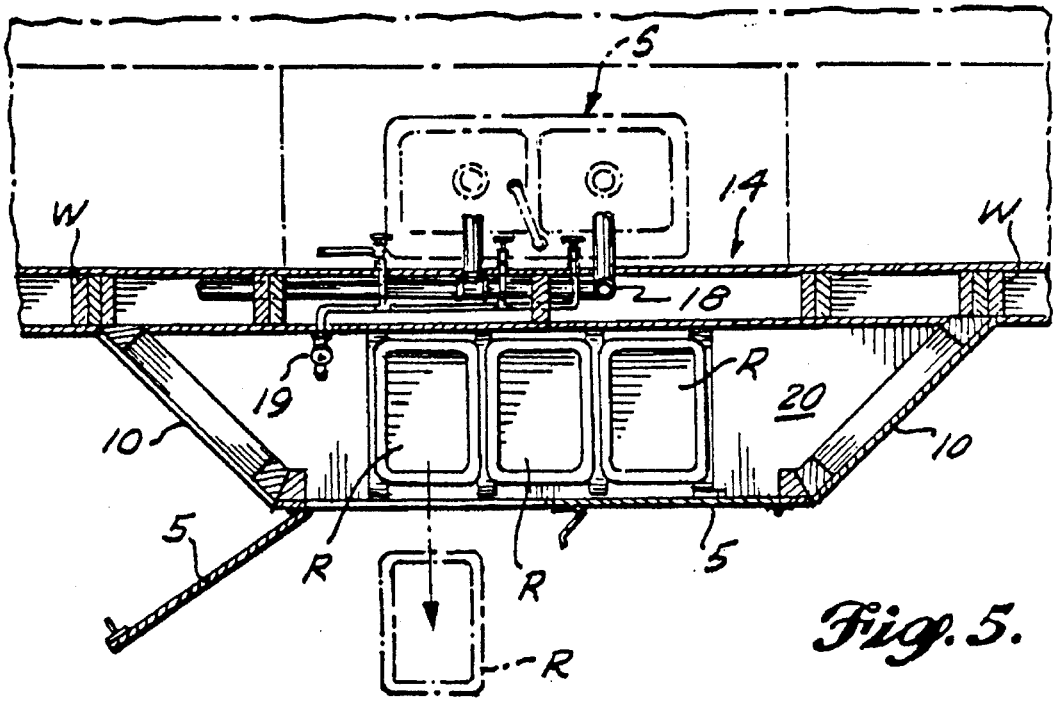
FIG. 5 is a further horizontal section through the auxiliary structure taken along line 5—5 of FIG. 1.

The lower portion of the U-shaped outer wall forms a housing for the receptacles R for holding recyclable or disposable waste material (hereinafter designated "waste") as shown in FIG. 5. The outer side of the housing has in it a doorway providing exterior access to the housing which is closed by a door or doors 5 shown in FIGS. 1 and 3 as outwardly opening doors mounted by hinges for swinging about upright axes. A header 6 extends across the top of the doorway opening closed by the door or doors 5 and constitutes a sill for oppositely-opening exterior conservatory casement windows 7. Located above the windows is a header structure 8 which extends over the top of the casement windows surmounted by a pitched roof 9.

The sides 2 of the structure include lower panels 10 closing the ends of the receptacle housing and upper conservatory casement exterior windows 11. The header structure 12 above these windows is surmounted by pitched side roof panels 13 joined to the central roof panel 9.

Figure 2:
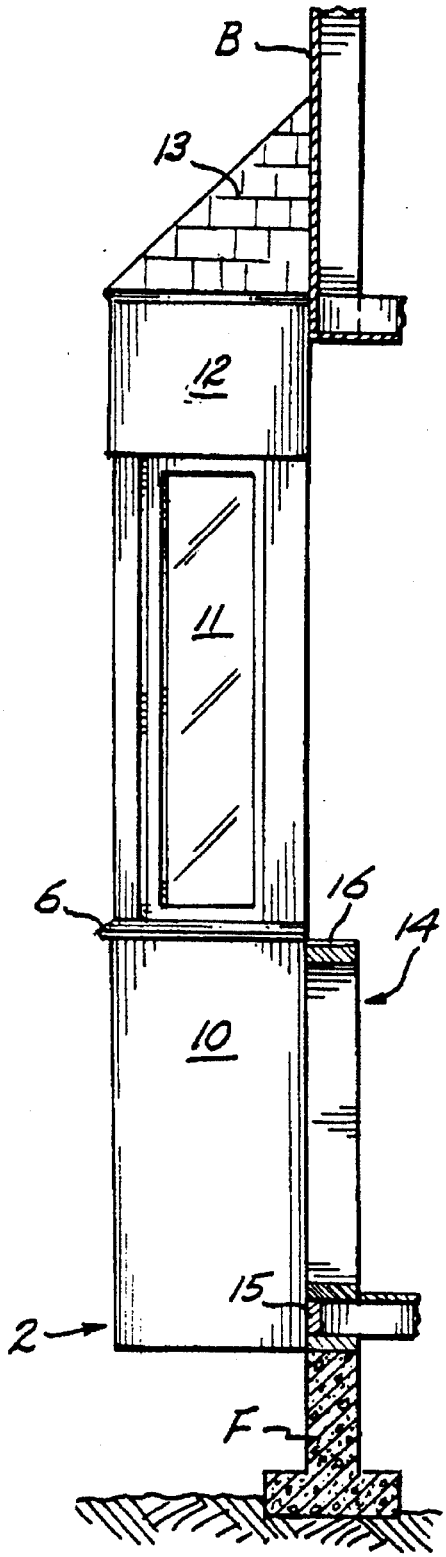
FIG. 2 is a side elevation of such auxiliary structure.

A key feature of the auxiliary enclosure structure is the provision of an interior integrating lower structural wall section 14 shown in FIG. 5 that juts inward from the main structure beyond the plane of the margin of the inwardly-opening recess formed by the conservatory bay window structure. As is evident from FIG. 3, the top of the inward opening of the enclosure is at least head high and the enclosure extends downward to floor level. The integrating structural inner wall has a foundation sill 15, and the auxiliary structure is supported on such structure as shown in FIGS. 2 and 3. The upper portion of this integrating structural wall has a header 16 connected to and supported from the sill by wall studs and defining the bottom of the opening from the building B in registration with the recess formed by the conservatory portion of the auxiliary structure. To accommodate the prefabricated enclosure, an opening is provided in the building B extending from floor to ceiling as shown in FIGS. 2 and 3. The enclosure is then annexed to the building by the integrating wall being fitted into the lower portion of the building opening and the upper portion of the enclosure abutting the exterior of the building. The integrating wall structure when in place in the building opening is located coplanar with the portions of the building wall W on opposite sides of the enclosure a shown in FIGS. 4 and 5 so that the ends of the integrating wall 14 fitted in the building opening can be secured to studs of the building wall W as shown in FIG. 5.

Figure 6:
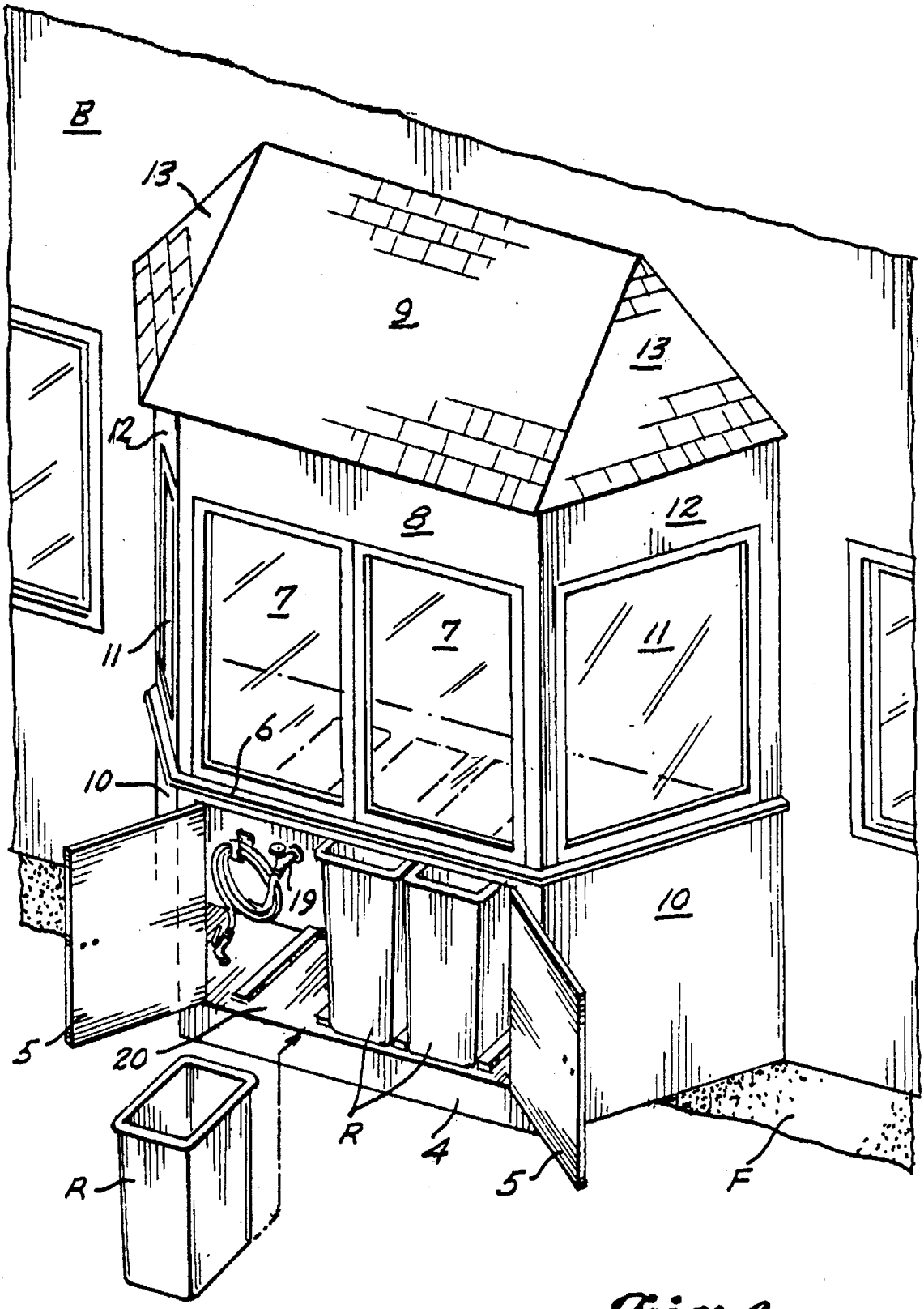
FIG. 6 is a top perspective of the exterior of the auxiliary structure.
Figure 7:
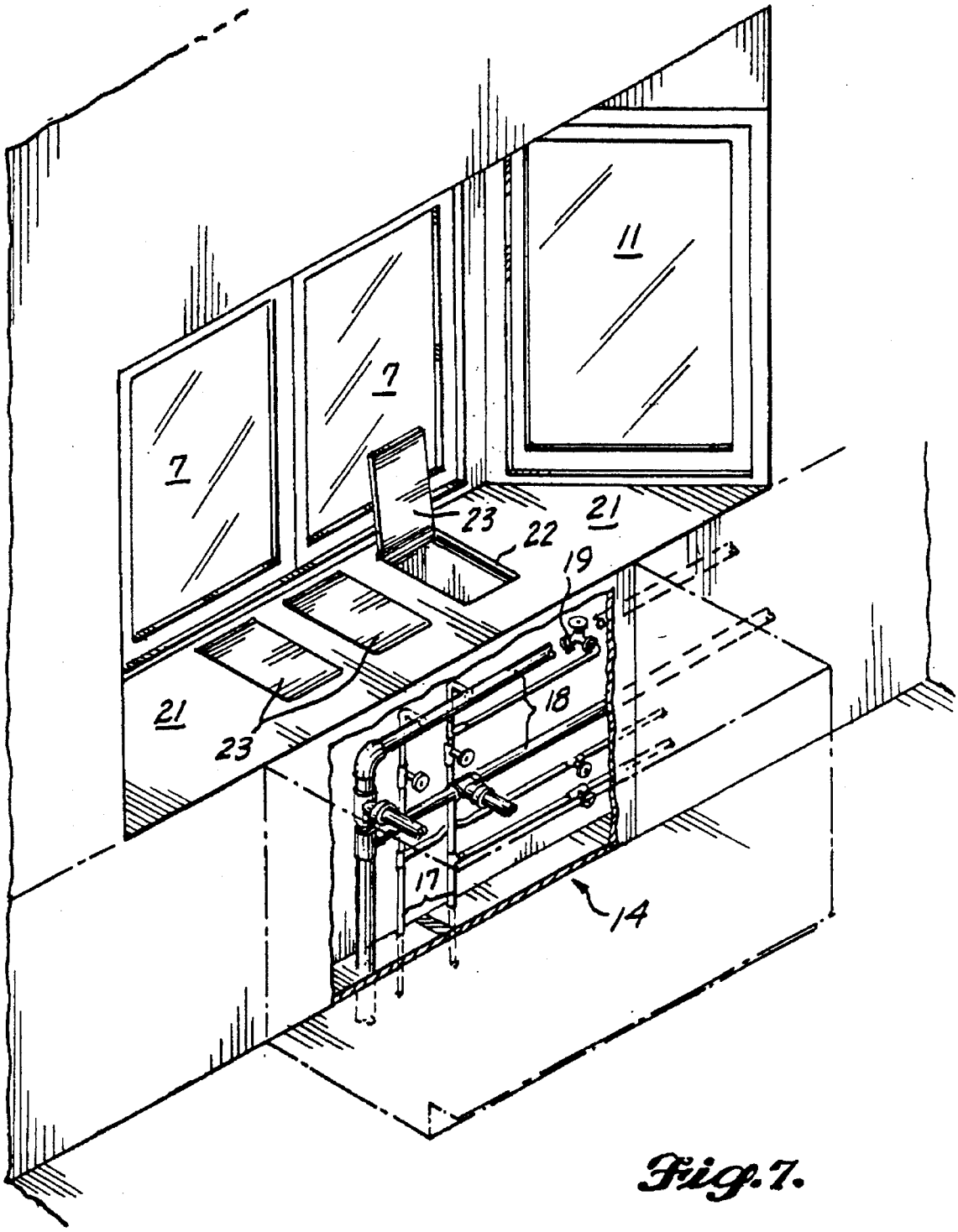
FIG. 7 is a top perspective of the interior of the bay window conservatory and the inner wall of the structure below it, parts being broken away, showing, in this configuration, plumbing installed in the auxiliary structure.

Preferably the integrating wall 14 is a utility wall which, when the auxiliary structure is prefabricated, will be fitted as shown in FIG. 7 with water supply pipes 17 and drain pipes 18 suitable for connecting to a double compartment sink S. Such supply and drain plumbing may also provide connections for a dishwasher (not shown) that can be located alongside the double basin sink. A branch from a water supply line 17 can be connected to a hose faucet 19 located on the back wall of the housing for the receptacles and accessible from the interior of such housing as shown in FIGS. 3 and 6 to which a hose can be connected for convenient washing of the interior of the housing.

While the recycling center could house a single receptacle to receive various types of recyclable waste mixed together, it is preferred that the housing floor 20 be of a size sufficient to support a plurality of receptacles R as shown in FIGS. 3, 5 and 6, one of which could be for metal cans, another for glass articles such as jars, and a third for waste paper and cardboard, for example. While one of the receptacles could be for kitchen garbage, it is possible that the double sink S include a disposal for grinding and disposing of kitchen food waste through the plumbing drain system. The header 16 of the integrating wall 14 will be integrated with the stationary counter 21 edge-connected to the enclosure wall structure as shown in FIGS. 3, 4 and 7 and forming the bottom of the bay window conservatory recess and the top of the housing for the receptacles R. Such bottom has in it openings 22, in number and location corresponding to the receptacles R in the housing below through which waste can be dropped directly into the respective appropriate receptacles R. The openings 22 are closed by individual trapdoors 23.

FIGS. 3, 4 and 7 show that the bottom 21 of the bay window conservatory recess and the openings 22 in it are located directly behind the counter in which the kitchen sink S is installed so that such openings are within convenient reach from the kitchen. At the same time, the exterior bay window configuration of the conservatory in the outer wall of the unobstructed recess in the upper portion of the auxiliary structure which recess has an unobstructed opening into the interior of the building a shown in FIGS. 3, 4 and 7 provides a sense of spaciousness to the kitchen by providing a view from the kitchen in the interior of the building through the recess and windows, and the conservatory recess bottom 21, which may be a coplanar outward extension of the kitchen counter, can serve as a support for plants and/or other decorations.

Figure 8:
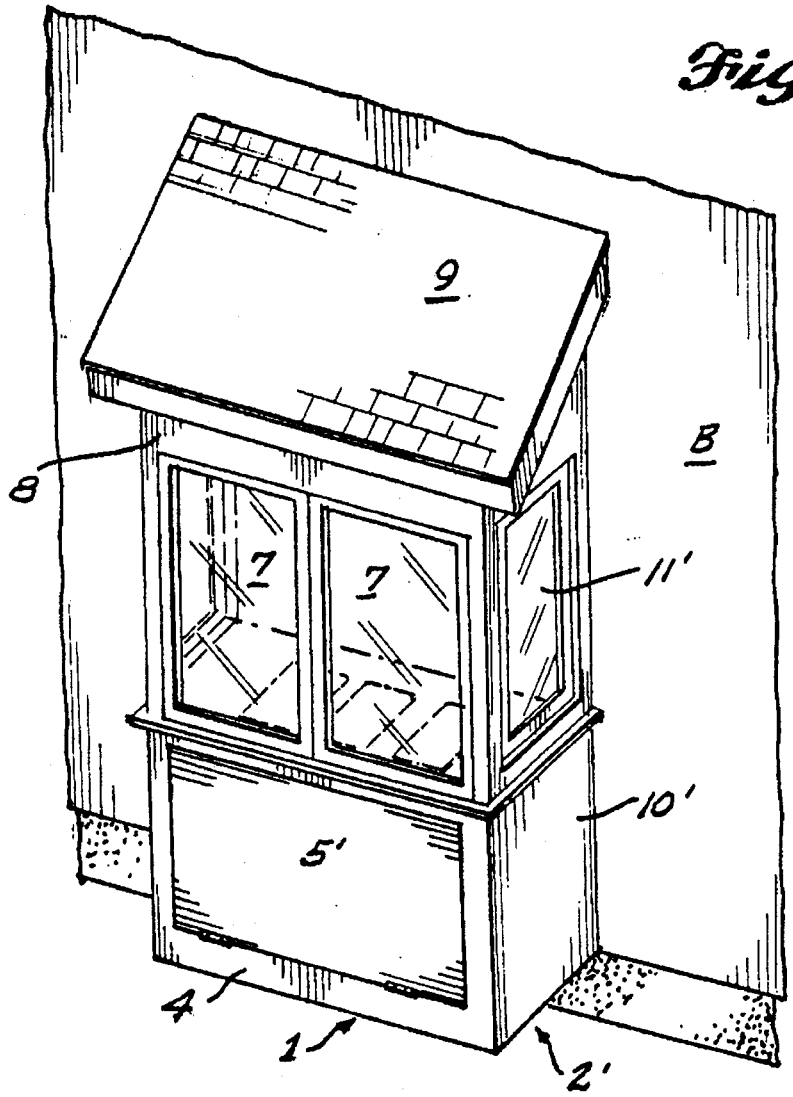
FIG. 8 is a top perspective of a modified form of auxiliary structure.
Figure 9:
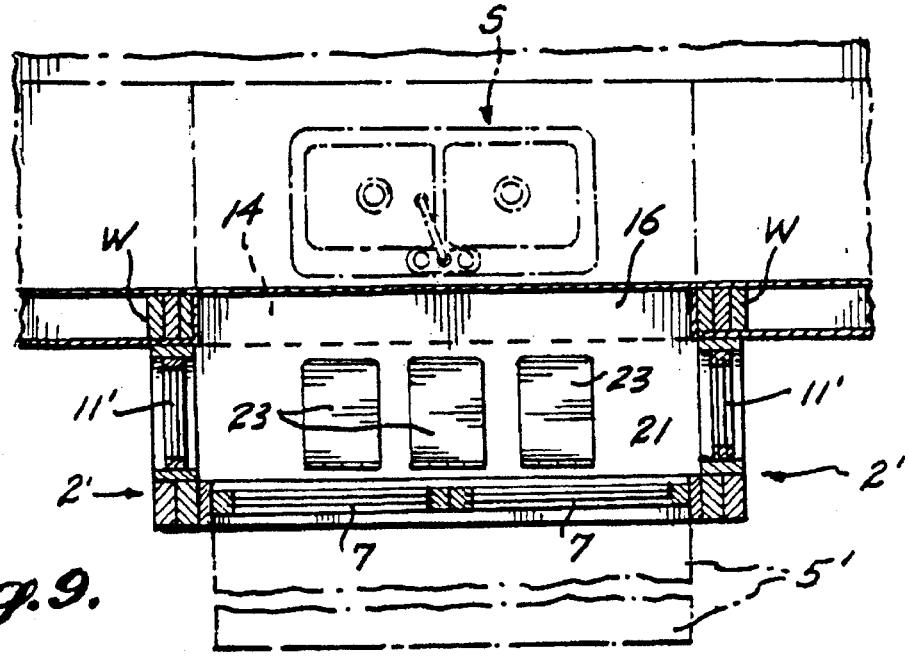
FIG. 9 is a horizontal section through the upper conservatory window portion of the modified auxiliary structure shown in FIG. 8.

While the conservatory illustrated in FIGS. 1 to 7, inclusive, has side panels 2 inclined at forty-five degrees relative to the front panel 1, the bay window could be of the rectangular type shown in FIGS. 8 and 9 having side panels 2' disposed perpendicular to the front panel 1. In this type of auxiliary structure, the side panels 2' are composed of end walls 10' of the receptacle housing and conservatory casement windows 11' without having any side roof panels. The interior of the rectangular auxiliary structure shown in FIGS. 8 and 9 may be similar to that of the auxiliary structure shown in FIGS. 1 to 7, including the integrating wall 14 that may be a utility wall fitted with plumbing and/or electrical wiring.

The opening in the outer side of the receptacle housing portion of the auxiliary structure can be closed by oppositely outward swinging doors 5 as shown in FIG. 6, or the opening can be closed by a drop door 5' hinged along the bottom so that it can swing outward and downward to form a ramp over which the receptacles can be moved as they are withdrawn from or inserted into the housing.

While the auxiliary structure of the present invention could be built in conjunction with a building, it is particularly well adapted to be prefabricated and integrated integrally into a building by incorporating the integrating wall 14 in a wall of the building B. The interior counter 21 and trim of the auxiliary structure would be made to harmonize with the finish of the building kitchen or other room to which the auxiliary structure is annexed, and the finish of the exterior walls and roof of the auxiliary structure would be constructed to harmonize with the wall finish and roofing of the building to which the conservatory enclosure is annexed.

We claim:

1. A conservatory enclosure for a waste receptacle comprising a prefabricated auxiliary structure forming the enclosure and being adapted for annexation to a building, said auxiliary structure including an outer wall of generally U-shaped horizontal cross section having an upper portion forming a bay window and an inwardly-opening recess, a stationary counter edge-connected to said outer wall and forming the bottom of said recess, said outer wall further having a lower portion forming a housing beneath said counter for enclosing a waste receptacle, and an opening through said counter for dropping waste from said recess into a receptacle in said housing, said auxiliary structure further including an integrating wall extending from said counter downward substantially to floor level and constructed separately from the building as an integral part of said auxiliary structure for incorporation as part of the structure of the building when said auxiliary structure is annexed to the building, said integrating wall being a utility wall in which plumbing is installed that is adapted for connection to a sink in the building alongside said utility wall after said auxiliary structure has been annexed to the building.

2. A conservatory enclosure for a waste receptacle for annexation to a building having a wall with an opening through it and a sink in the building alongside such wall, such enclosure comprising an outer wall of generally U-shaped cross section having an upper portion forming a bay window and an inwardly-opening unobstructed recess in registration with the wall opening for opening into the building, a stationary counter located outwardly of the sink, edge-connected to said outer wall and forming the bottom of said unobstructed recess, said outer wall further having a lower portion forming a housing beneath said stationary counter and located outwardly of the sink for enclosing a waste receptacle, and an opening through said counter outwardly of the sink for dropping waste from said unobstructed recess into a receptacle in said housing.

3. The enclosure defined in claim 2, in which the enclosure is a prefabricated auxiliary structure adapted for annexation to a building and includes an integrating wall extending from the recess downward substantially to floor level and constructed separately from the building as an integral part of said auxiliary structure for incorporation as part of the structure of the building when the auxiliary structure is annexed to the building.

4. The enclosure defined in claim 3, in which the integrating wall is a utility wall in which plumbing is installed, a doorway in the lower portion of the outer wall providing exterior access to the housing, and a faucet located within the housing and connected to said plumbing in the utility wall.

5. The enclosure defined in claim 3, in which the integrating wall is a utility wall in which plumbing is installed, which plumbing is adapted for connection to the sink in the building after the auxiliary structure has been annexed to the building.

6. The enclosure defined in claim 3, in which the integrating wall is a utility wall in which electric wiring is installed.

* * * * *